US005281351A

United States Patent [19]

Romeo et al.

[11] Patent Number: 5,281,351

[45] Date of Patent: Jan. 25, 1994

[54] PROCESSES FOR INCORPORATING ANTI-SCALANTS IN POWDERED DETERGENT COMPOSITIONS

[75] Inventors: Joseph Romeo, Teaneck, N.J.; Anthony A. Rapisarda, Elmhurst, N.Y.; Jose A. Lopez, Cresskill, N.J.

[73] Assignee: Lever Brothers Company, Division of Conopco, Inc., New York, N.Y.

[21] Appl. No.: 804,134

[22] Filed: Dec. 6, 1991

[51] Int. Cl.[5] ..... C11D 7/12; C11D 11/00; C11D 11/04; C11D 17/06

[52] U.S. Cl. ..... 252/99; 23/313 R; 23/313 FB; 252/102; 252/174; 252/174.13; 252/174.14; 252/174.16; 252/174.19; 252/174.24; 252/174.25; 252/527; 264/117; 427/213; 427/220

[58] Field of Search ..... 252/95, 99, 174.14, 252/174.16, 546, 102, 174, 174.13, 174.19, 174.24, 174.25, 527; 23/313 R, 313 S, 313 FB; 264/117; 427/213, 220

[56] References Cited

U.S. PATENT DOCUMENTS

| | | | |
|---|---|---|---|
| 2,264,103 | 11/1941 | Tucker | 210/698 |
| 4,102,799 | 7/1978 | Finck | 252/99 |
| 4,124,519 | 11/1978 | Lannert | 252/99 |
| 4,379,069 | 4/1983 | Rapisarda et al. | 252/135 |
| 4,919,845 | 4/1990 | Vogt | 252/526 |
| 4,973,419 | 11/1990 | Romeo et al. | 252/99 |

*Primary Examiner*—Dennis Albrecht
*Attorney, Agent, or Firm*—A. Kate Huffman

[57] ABSTRACT

Novel processes for incorporating anti-scalant agents having acidic functionalities in zero-P or low phosphate built powder detergents to provide an automatic dish-washing detergent of improved solubility.

9 Claims, No Drawings

PROCESSES FOR INCORPORATING ANTI-SCALANTS IN POWDERED DETERGENT COMPOSITIONS

FIELD OF THE INVENTION

The present invention relates to processes for incorporating anti-scalants in powdered detergent compositions which are free of phosphate builders (zero-P). Specifically the incorporation of anti-scalants to form stable powdered detergent by three novel processes is described.

BACKGROUND OF THE INVENTION

Efforts have been made since the late 1960s to replace the high levels of phosphate builders in household detergent products with non-phosphate ingredients which fulfill builder functions without causing environmental damage.

Builders in automatic dishwashing products function to (1) provide alkalinity, (2) sequester hardness ions and (3) disperse soils so as to prevent redeposition on clean ware surfaces. Sodium carbonate has been used as a phosphate builder alternative affording a cost effective source of alkalinity and functioning to lower the free calcium ion concentration in the wash solution. However, sodium carbonate has the tendency to deposit calcite crystals or other forms of calcium carbonate in hard water and thus to cover both tableware and dishwasher interiors with a white crust. This problem persists even when sodium carbonate is used in combination with sodium citrate.

When carbonate products are used in hard water, encrustation is believed to result via the formation of invisible minute calcite crystal nuclei which then grow to visible size. In a super-saturated solution of calcium carbonate, nucleation occurs during all washes but after a few washes all surfaces in the dishwasher are covered with growing crystals and additional calcium carbonate crystallizes on those crystals already present. It is believed that sequesterants such as sodium citrate prevent the formation of amorphous calcium carbonate.

As early as 1936, U.S. Pat. No. 2,264,103 was issued for a process of softening hard water using certain organic acid salts including citric acid U.S. Pat. No. 4,102,799 disclosed a dishwasher detergent composition consisting essentially of a citrate builder salt in combination with at least one additional builder salt such as silicate, carbonate, etc. GB 1,325,645 also disclosed a dishwasher composition comprising an alkali metal salt of citric acid, alkali metal carbonate and other components.

As noted above although sodium citrate prevents the formation of amorphous calcium carbonate, once calcite crystals are present, the citrate rapidly loses most of its calcium ions to the calcite.

Therefore, anti-nucleation agents also termed anti-scalants, or scale inhibitors have been used to inhibit the development of microscopic nuclei which grow to visible size and then the anti-nucleation agents redisperse to act on other nuclei. The inhibition of calcite crystal growth can prevent encrustation. Polyphosphates, phosphonates, polysulfonates and polycarboxylate polymers are also known in the art to reduce calcium carbonate deposition from detergent products which are built with sodium carbonate.

Ideally, therefore, a zero-P or low phosphorus powder detergent contains a sequestrant, such as citrate; an inexpensive source of alkalinity such as sodium carbonate and an anti-scalant or scale inhibitor such as polycarboxylate, phosphonate or polysulfonate.

Anti-scalants which are presently available are in aqueous form or powdered forms having a particle size which passes through a 50 mesh U.S. Screen. Particle sizes which pass through a 14 mesh U.S. Screen and are no larger than α 50 mesh U.S. Screen are however desirable for the invention. Since commercially available anti-scalants do not fit these criteria novel processing methods were required to overcome these problems.

Unfortunately, it has been found that many suitable anti-scalants which are available are provided in their acid forms, as partially neutralized acids, or otherwise contain a free acid. The presence of acidic species in anti-scalants poses a problem in the manufacture of dishwasher detergents. Specifically, if such acidic species are not neutralized, but sprayed directly on the detergent ingredients which include silicate, it is known that the acidic constituent has a destabilizing effect on the silicate component to liberate insoluble silica. This effect was believed to be specific for solid silicates as discussed in U.S. Pat. No. 4,379,069 (Rapisarda et al.).

It has now been found a similar effect can occur with aqueous silicates. An additional problem associated with aqueous anti-scalants, whether acidic or neutralized, is the high level of water (about 40 to 60%) these anti-scalants contain. In detergent manufacturing, non-phosphate builders generally do not have the absorptive capacity of the phosphate builder nor do they generally form stable hydrates in manufacture. For example, sodium citrate is generally used in either its dehydrate form or anhydrous form. When relatively high levels of anti-scalant are required for a product, and the anti-scalants are in aqueous form, prolonged drying times are required to remove excess water resulting in high cost for energy and the reducing in manufacturing efficiency.

SUMMARY OF THE INVENTION

It is therefore an object of the present invention to provide a process for incorporating unneutralized liquid anti-scalants in detergent powders to improve solubility.

It is another object of the invention to provide a process for incorporating neutralized anti-scalant powders in powdered detergent products to form stable and non-segregating formulations.

Another object of the invention is to provide a process for granulating aqueous anti-scalant agents suitable for detergent products.

It is a further object of the invention to provide a zero-P or low phosphorus powdered detergent which is free flowing and soluble and which may be concentrated so that dosage uses may be half of conventional dishwashing products to provide effective cleaning.

DESCRIPTION OF PREFERRED EMBODIMENTS

The processes of the present invention provide zero-P or low phosphorus powdered automatic dishwashing detergents made with anti-scalants in their acidic or partially neutralized aqueous form without the problem of liberating free silica in use. Additionally, neutralized solid descalants which are generally available only in powder form may be manufactured by an inventive second process without the problem of segregation of components in the finished powder. A third process for producing such zero-P or low-P detergents involves the granulation of neutralized anti-scalants. Components of the detergent products produced by one of the three inventive processes are described below.

Scale Inhibitors and Anti-Scalants

As noted above, an anti-scalant agent inhibits the development of the microscopic nuclei to the critical size and then the agent redisperses to act on other nuclei. Anti-scalant agents are also useful in broader applications such as in industrial boilers, water purification, evaporators, etc.

Any conventional anti-scalant (sometimes described as dispersant) which is used to prevent the deposition of sparingly soluble salt scale, such as $CaCO_3$ in water systems is considered within the scope of this invention.

Anti-scalant agents are available in either powder or solution form, generally solution form is available, and may be provided as acids, partially neutralized acids or otherwise contain a free acid. Examples of suitable phosphorus containing scale inhibitors include methylene phosphonates, methylene phosphonic acid, and other phosphates and phosphonates listed in McCutcheon's *Functional Materials,* North America Edition, Volume 2, McCutcheon Division Publishing, Glen Rock, N.J. (1991), herein incorporated by reference.

Preferred methylene phosphonates include pentasodium amino tris, hexamethylene diamine tetra, hexapotassium, octasodium diethylene triamine penta.

Particularly preferred methylene phosphonic acids include diethylene triamine penta. Especially preferred is hydroxy ethylidene diphosphonic acid in aqueous solution supplied as Arquest 710 by Aquaness Chemicals of Houston, Tex. or as Dequest 2010 by Monsanto of St. Louis, Mo. The same diphosphonic acid is available in powder form as Dequest 2016D by Monsanto or amino tris (methylene phosphonic acid) sold as Arquest 709 by Aquaness Chemicals. Polymeric anti-scalants suitable for the invention include polymaleic acid and its sodium salts (Belclene 200 and 201) supplied by Ciba-Geigy of Greensboro, N.C.), a polycarboxylate polymer series prepared from the copolymerization of acrylic and maleic acid sold under the Sokalan CP Series by BASF of Morristown, N.J., and sodium polyacrylates and polyacrylic acid available under the Sokalan PA Series supplied by BASF.

A polyacrylic acid and a sodium or ammonium polyacrylate are also suitable, such as products produced by Alco Chemical Corp., Division of National Starch and Chemicals, known as as the Alcosperse Series, Colloids sold by Rhone-Poulenc Corp. of Dalton, Ga., Good-rite Series supplied by B.F.Goodrich of Cleveland, Oh. and Acusol Series supplied by Rohm & Haas of Philadelphia, Penna.

Particularly preferred anti-scalants include Colloid 17/50; Colloid 211, 223, 223(D) and 274; Good-rite K-732, K-752, K-7058, K-G00N; Acusol 445, and Alcosperse 602N.

Additional anti-scalants suitable for the invention are described in Kirk-Othmer *Encyclopedia of Chemical Technology,* rd Edition, Volume 7, John Wiley & Sons, NY (1979), describing anti-nucleation agents or anti-scalants as dispersant materials.

A sulfonated styrene maleic anhydride copolymer is also a suitable anti-scalant for the invention and may be obtained as Versa TL 7 supplied by National Starch of Bridgewater, N.J. Other copolymers include Varlex D-82 supplied by National Starch and sodium lignosulfonates supplied under the trademark Orzans(R) by ITT Rayonier of Seattle, Wash.

Builders

Organic builders, preferably at a level of from 0.5 to 0%, and especially preferred 10 to 45%, used in the present zero-P or low phosphorus detergents include water soluble i.e., sodium, potassium, ammonium salts of amino polycarboxylic acids and hydroxy carboxylate acids and mixtures thereof. The acid portion of the salt may be derived from acids such as nitrilotriacetic acid (NTA), N-(2-hydroxyethyl) nitrilodiacetic acid, nitrilodiacetic acid, ethylenediaminetraacetic acid (EDTA), N-(2-hydroxyethyl) ethylenediamine triacetic acid, 2-hydroxy ethyliminodiacetic acid, diethylenetriamine pentaacetic acid, citric acid, dipicolinic acid (DPA) etc., and mixtures thereof. Polyacrylate builders and polyacetal carboxylates such as those described in U.S. Pat. Nos. 4,144,226 and 4,146,495 may also be used.

Other useful organic detergent builders include sodium and potassium salts of the following: phytates, polyphosphonates, oxydisuccinates, oxydiacetates, carboxymethyloxy succinates, tartrate monoacetates, tartrate diacetates, tetracarboxylates, starch and oxidized heteropolymeric polysaccharides. Crystalline and amorphous aluminosilicates are also useful.

Surfactants

Nonionic surfactants include those detergent compounds which contain an organic hydrophobic group and a hydrophilic group which is a reaction product of a solubilizing group such as carboxylate, hydroxyl, amido or amino with ethylene oxide or propylene oxide or with a polyhydration product thereof such as polyethylene glycol.

Nonionic synthetic detergents can be broadly defined as compounds produced by the condensation of alkylene oxide groups with an organic hydrophobic compound which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. About 0.5 to about 6.0% of a nonionic is useful in the invention. Illustrative but not limiting examples of the various chemical types suitable as nonionic surfactants include:

(a) polyoxyethylene and/or polyoxypropylene condensates of aliphatic carboxylic acids, whether linear or branched-chain and unsaturated or saturated, containing from about 8 to about 18 carbon atoms in the aliphatic chain and incorporating from 5 to about 50 ethylene oxide or propylene oxide units. Suitable carboxylic acids include "coconut" fatty acids (derived from coconut oil) which contain an average of 12 carbon atoms, "tallow" fatty acids (derived from tallow-class fats) which contain a myristic acid, stearic acid and lauric acid.

(b) polyoxyethylene and/or polyoxypropylene condensates of aliphatic alcohols,whether linear or branched-chain and unsaturated or saturated, containing from about 6 to about 24 carbon atoms and incorporating from about 5 to about 50 ethylene oxide or propylene oxide units. Suitable alcohols include the "coconut" fatty alcohol, "tallow" fatty alcohol,lauryl alcohol, myristyl alcohol and oleyl alcohol. Particularly preferred nonionic surfactant compounds in this category are the "Neodol" type products, a registered trademark of the Shell Chemical Company.

Particularly preferred are nonionic surfactants having the formula:

$$RO-(CH_2\underset{\underset{R'}{|}}{C}HO)_x(CH_2CH_2O)_y(CH_2\underset{\underset{R''}{|}}{C}HO)_z-H$$

wherein R is a linear, alkyl hydrocarbon having an average of 6 to 10 carbon atoms, R' and R'' are each linear alkyl hydrocarbons of about 1 to 4 carbon atoms, x is an integer from 1 to 6, y is an integer from 4 to 15 and z is an integer from 4 to 25. A particularly preferred example of this category is sold under the registered trademark of Poly-Tergent SLF-18 by the Olin Corporation, New Haven, Connt. Poly-Tergent SLF-18 has a composition of the above formula where R is a $C_6$–$C_{10}$ linear alkyl mixture, R' and R'' are methyl, x averages 3, y averages 12 and z averages 16. Another surfactant from this category has the formula $$C_{8-10}O(CH_2CH_2O)_{7.81}(CH_2\underset{\underset{CH_3}{|}}{C}HO)H_{14.45}$$

(c) polyoxyethylene or polyoxypropylene condensates or alkyl phenols, whether linear or branched-chain and unsaturated or saturated, containing from about 6 to about 12 carbon atoms and incorporating from about 5 to about 25 moles of ethylene oxide or propylene oxide.

(d) polyoxyethylene derivatives of sorbitan mono-, di-, and tri-fatty acid esters wherein the fatty acid component has between 12 and 24 carbon atoms. The preferred polyoxyethylene derivatives are of sorbitan monolaurate, sorbitan trilaurate, sorbitan monopalmitate, sorbitan tripalmitate, sorbitan monostearate, sorbitan monoisostearate, sorbitan tristearate, sorbitan monooleate, and sorbitan trioleate. The polyoxyethylene chains may contain between about 4 and 30 ethylene oxide units, preferably about 20. The sorbitan ester derivatives contain 1, 2 or 3 polyoxyethylene chains dependent upon whether they are mono-, di-, or tri-acid esters.

(e) polyoxyethylene polyoxypropylene block polymers having the formula:

$$HO(CH_2CH_2O)_a(CH(CH_3)CH_2)_b(CH_2CH_2O)_cH$$

wherein a, b and c are integers reflecting the respective polyethylene oxide and polypropylene oxide blocks of said polymer. The polyoxyethylene component of the block polymer constitutes at least about 40% of the block polymer. The material preferably has a molecular weight of between about 2,000 and 10,000, more preferably from about 3,000 to about 6,000. These materials are well known in the art. They are available under the trademark "Pluronics", a product of BASF Wyandotte Corporation.

Examples of other suitable surfactants include low-foaming anionics such a dodecyl hydrogen phosphate, methyl napthalene sulfonate'sodium 2-acetamido-hexadecane-1-sulfonate and mixtures thereof. Preferred anionics include materials selected from the class of branched alkali metal mono- and di-$C_8$–$C_{14}$ alkyl diphenyl oxide mono- and disulfonates and linear alkali metal mono- and di $C_{8-14}$ alkyl diphenyl oxide mono- and disulfonates. Mixtures of any of the foregoing surfactants or of surfactants from any of the enumerated categories may be used. If desired, anti-foaming agents may be utilized as well. Antifoaming agents typically include a hydrocarbon oil and/or a silicone oil or together with particles such as silica. Mono and distearyl acid phosphates are also preferred suds suppressers.

Silicates

Of the alkaline metal silicates, sodium silicate having a ratio of $SiO_2$: $Na_2O$ of from about 1.0 to about 3.3, preferably from about 2 to about 3.2 is useful for the present invention. The liquid silicate form is preferred. Solid silicates may also be used either alone or in combination with liquid silicates.

Alkaline and Filler Salts

Alkalinity sources and filler salts useful in the present invention include up to 80%, preferably from 5 to 60%, especially 10 to 50% by weight of a silicated alkali metal or ammonium or substituted ammonium inorganic, non-phosphorus salt. Preferably the salt is alkali metal or ammonium carbonate, bicarbonate or sesquicarbonate or mixtures thereof or a mixture thereof with other alkali metal inorganic salts such as sulfate. The weight ratio of alkali metal carbonate, bicarbonate or sesquicarbonate or mixtures thereof to alkali metal sulfate or other inorganic salt or mixtures thereof is from 10:1 to 1:10, preferably 5:1 to 1:5. Other inorganic, non-phosphorus salts include borax, and limited amounts of alkali metal or ammonium chloride and mixtures thereof.

From 10 to 50% by weight of non-silicated inorganic, non-phosphorus salts including crystalline and amorphous aluminosilicates, solid silicates and salts mentioned above are also included. Preferably, the silicated non-phosphate salt is conditioned to provide about 40 to 70% loss of silicate moisture. The product density is preferably in the range of 40–50 lbs/cu ft., especially about 47 lbs/cu ft. Generally, the salt is "silicated" by spraying with an aqueous silicate solution and agglomerated.

Bleaches

A wide variety of bleaching agents may be employed for use with these detergent powders. Both halogen and peroxygen type bleaches are encompassed by this invention.

Among the suitable halogen donor bleaches are heterocyclic N-bromo and N-chloro imides such as trichlorocyanuric, tribromocyanuric, dibromo and dichlorocyanuric acids, and salts thereof with water solubilizing cations such as potassium and sodium. An example of the hydrated dichlorocyanuric acid is Clearon CDB56, a product manufactured by the Olin Corp., Cheshire, Cont. Such bleaching agents may be employed in admixtures comprising two or more distinct chlorine donors. An example of a commercial mixed system is one available from the Monsanto Chemical Company under the trademark designation "ACL-66" (ACL signifying "available chlorine" and the numerical designation "66", indicating the parts per pound of available chlorine) which comprises a mixture of potassium dichloroisocyanurate (4 parts) and trichloroisocyanurate acid (1 part).

Other N-bromo and N-chloro imides may also be used such as N-brominated and N-chlorinated succinimide, malonimide, phthalimide and naphthalimide. Other compounds include the hydantoins, such as 1, 3-dibromo and 1,3-dichloro-5,5-dimethylhydantoin, N-monochloro-C, C-dimetylhydantoin methylenebis(N-bromo-C,C-dimethylhydantoin); 1,3-dibromo and 1,3-dichloro 5-methyl-5-n-amylhydantoin, and the like. Further useful hypohalite liberating agents comprise tribromomelamine and trichloromelamine.

Dry, particulate, water-soluble anhydrous inorganic salts are likewise suitable for use herein such as lithium, sodium or calcium hypochlorite and hypobromite.

Preferred chlorinating agents include potassium and sodium dichloroisocyanurate dehydrate, chlorinated trisodium phosphate and calcium hypochlorite. Particularly preferred are sodium or potassium dichloroisocyanurate dehydrate. Preferred concentrations of all of these materials should be such that they provide about 0.2 to about 1.5% available chlorine. Hypohalite liberating compounds may generally be employed in automatic dishwashing detergents at a level of from 0.5 to 5% by weight, preferably from 0.5 to 3%.

Suitable chlorine-releasing agents are also disclosed in the ACS monograph entitled "Chlorine—Its Manufacture, Properties and Uses" by Sconce, published by Reinhold in 1962, incorporated herein reference.

Among the oxygen bleaches which may be included in the invention are alkali metal and ammonium salts of inorganic peroxygen compounds such as perborates, percarbonates, persulfates, dipersulfates and the like. Generally the inorganic oxygen compound will be used in conjunction with an activator such as TAED (tetraacetyl ethylene diamine), sodium benzoyl oxybenzene sulfonate or choline sulfophenyl carbonate or a catalyst such as manganese or other transition metal, as is well known in the bleaching art. Insoluble organic peroxides such as diperoxydodecanedioic acid (DPDA) or lauroyl peroxide may also be used. Generally, the peroxygen compounds are present at a level of from 0.5 to 20% by weight, 0.005 to 5% catalyst and 1 or 0.5 to 30% activator.

pH

The pH of automatic dishwashing compositions in accordance with the invention preferably range from 9 to 12, especially from 10 to 11 at a concentration of one percent. In general, the alkalinity of the composition is adjusted by varying the levels of alkaline builder salt.

Optional Ingredients

The formulation may contain minor amounts of other ingredients such as perfumes, dyes, colorants, anti-tarnish agents, soil suspending agents and hydrotropes. Enzymes may also be present at levels from about 0.5 to 3% by weight,preferably from about 0.5 to 2.0% and especially 0.5 to 1.5%. If enzymes are used in the formulation, the chlorine bleach active should be replaced with an oxygen bleach active unless the enzymes are chlorine stable. Additionally, when oxygen bleaches are used, it is advantageous to use a bleach activator as discussed above in the bleach section.

Novel Processes

Three processes according to the invention may be used to incorporate an anti-scalant in the detergent compositions as follows:

(1) In situ neutralization of acidic liquid anti-scalant by its addition to an alkaline agent such as sodium carbonate alone or in combination with other inorganic salts prior to adding a nonionic surfactant and liquid sodium silicate;

(2) Spraying liquid silicate onto an alkaline agent alone or in combination with a nonionic surfactant or other alkaline agents and then adding a neutralized powdered anti-scalant agent; and (3) Co-granulation of a liquid anti-scalant with one or more inorganic salts.

(1) In Situ Neutralization

A liquid anti-scalant agent having acidic functionalities in an amount of about 0.5 to about 15% is combined with at least one alkaline agent either alone or in combination with inorganic salts to neutralize the anti-scalant agent in situ. The alkaline agent is preferably sodium carbonate, sodium bicarbonate or sodium sesquicarbonate which makes up to about 40%, preferably 20–40%, of the final compositions. The neutralized anti-scalant mixture is then combined with about 0.5 to about 6.0% of a nonionic surfactant to form a blended mixture. The blended mixture is then agglomerated with from about 10 to about 40%, preferably 10 to 20% liquid sodium silicate. The agglomerated mixture is preferably then sized and fluidized to obtain an overage particle size ranging from between 14 and 50 U.S. Mesh Screens, which is in the range of about 750–800 microns average particle diameter; and to drive off excess free moisture from the agglomerated mixture. Preferably the agglomerated mixture contains about 2.5–4.5% free moisture. The agglomerated mixture is then added to about 10 to about 60% of a non-phosphate builder and either a chlorine donor providing about 0.5 to about 1.5% available chlorine or a peroxygen type bleach. Any optional ingredients are then added to form the final mixture.

(2) Neutralized Anti-Scalant Powder

An alkaline salt mixture is prepared by combining about 20 to about 50 wt. % of at least one alkaline agent alone or in combination with inorganic salts to form a blended mixture. About 10 to about 40 wt. % preferably 10% to 20%, liquid sodium silicate is then added to the blended mixture. A neutralized solid powdered anti-scalant agent in a range from about 0.5 to about 6 wt. % is then added to the silicated blended mixture. The silicated blended mixture is then preferably sized and fluidized as is conventionally known in the art to obtain an average particle size each sample int he range of about 750 to about 800 microns to drive off excess free moisture form the agglomerated mixture. This average particle size falls between 14 and 50 U.S. Mesh Screens. Preferably the agglomerated mixture contains about 2.5 to about 4.5% free moisture. Other ingredients to be added to the formulation including a non-phosphate builder, chlorine donor etc. are added to the mixture.

(3) Co-Granulation of Anti-Scalant Agent

A liquid anti-scalant agent is granulated by spraying the solution onto one or more salts, including alkaline agents, and drying the anti-scalant/alkaline mixture. A second mixture containing surfactant, builder and other detergent ingredients is prepared and dried. The anti-scalant/alkaline mixture is then combined with the second detergent ingredient mixture and granulated according to conventional methods to form a co-granulated product having a particle size of about 14 to about 50 mesh, U.S. Screens.

The processes of the invention are more fully described by the non-limiting examples. Unless otherwise indicated, all percentages given are by weight for the active species present.

EXAMPLES 1-2

The formulation of Example 1 was prepared by combining sodium carbonate and sodium sulfate in a Kitchen Aid mixer. A nonionic surfactant, Polytergent SLF-18 was then dripped onto the mixture of alkaline salts followed by a dropwise addition of the sodium silicate. An un-neutralized liquid. anti-scalant Dequest 2010 containing 3% phosphoric acid and 37% water was then dripped onto the silicated alkaline salt mixture to form an agglomerated mixture. Subsequently, the agglomerated mixture was conditioned on an Aeromatic fluid bed at 70° F. for 20 minutes and then transferred to a Twin Shell blender. The other ingredients of the formulation were added to the blender and mixed for five minutes. A sample of Example 1 was taken for for determination of solubility and results are reported in Table 2 below.

Example 2 was prepared in an analogous manner to Example 1 except that the sodium polyacrylate, Alcosperse 602N was used as the liquid anti-scalant. Sodium polyacrylate with a molecular weight of about 4500 contributed 3.7 x as much water to the formulation as the Dequest 2010 did. Thus Example 2 was dried at 105° F. for 18 hours prior to fluidization in the Aeromatic fluid bed as described above. Following the addition of the remaining detergent ingredients, a sample of Example 2 was taken for determination of solubility and the results are reported in Table 2 below. Solubility of the formulations of Examples 1 and 2 was determined by adding 2.5 grams of the test formulations to 1000 ml of distilled water heated to 100° F. in a 1500 ml beaker. The heated water was continuously stirred for 7 minutes and the speed of the stirring motor was adjusted to between 150 and 160 rpm with the height of the stirrer blade (1.75" diameter, 30°-45° pitch) being maintained at about one inch from the bottom of the beaker. At the end of the seven minutes stirring time, the stirrer was removed and if any undissolved material appeared to be settling out in the beaker, the mixture was stirred with a stirring rod to get the insoluble material back in suspension and then immediately filtering the mixture with the aid of suction, through a black cloth disc (5 inch diameter) place on the perforated disc of a Buchner funnel of appropriate size. Two to three minutes after all of the transferred liquid in the Buchner funnel had passed through the black cloth, the cloth was removed and the amount of residue, if any remaining on the black cloth was qualitatively compared with a predetermined set of standards with the ratings as set forth in Table 1.

TABLE 1

| Rating | Solubility Ratings<br>Amount of Residue on Black Cloth |
|---|---|
| 0 | No residue |
| 1 | Very slight residue |
| 2 | Slight residue |
| 3 | Moderate residue |
| 4 | Heavy residue |
| 5 | Extremely insoluble |

| | Examples 1-2 | |
|---|---|---|
| | 1 | 2 |
| Sodium carbonate | 30.00 | 30.00 |
| Sodium sulfate | 23.50 | 21.40 |
| Polytergent SLF-18 | 3.50 | 3.50 |
| Sodium silicate, 2.4r | 11.00 | 11.00 |
| Phosphonate[a] (aqueous) | 2.40 | — |

TABLE 1-continued

| | | |
|---|---|---|
| Sodium polyacrylate[b] (aqueous) | — | 4.50 |
| Sodium citrate dihydrate | 20.00 | 20.00 |
| Clearon CDB 56 | 3.50 | 3.50 |
| Perfume | 0.20 | 0.20 |
| Water | 5.90 | 5.90 |

[a]Dequest 2010 contains 60% phosphonate, 3% $H_3PO_4$, 37% water
[b]Alcosperse 602N contains 45% sodium polyacrylate, 55% water

EXAMPLE 3

Example 3 was formulated in he same manner as Example 1 except that acidic liquid Dequest 2010 was neutralized in-situ in Example 3. The liquid anti-scalant was neutralized by its addition to the sodium carbonate and sodium sulfate prior to the addition of the nonionic surfactant (Polytergent SLF-18) and liquid silicate. Following fluidization as in Examples 1-2, and the blending with the other detergent ingredients of the formulation, a sample of Example 3 was taken for determination of solubility and the results are given below in Table 2.

TABLE 2

| | Solubility Rating<br>Storage | | Example | | |
|---|---|---|---|---|---|
| | Time | Temp. | 1 | 2 | 3 |
| Solubility | Initial | 72° F. | 5 | 1 | 1-2 |
| " | 1 Mo. | 72° F. | 5+ | 2 | 1 |
| " | 2 Mo. | 72° F. | 5+ | 2 | 0 |
| Visual Observation | | | | free flowing non-caking | |

EXAMPLE 4

Example 4 demonstrates that an anti-scalant provided as a fine powder can be affectively incorporated in a detergent formulation. Weighed amounts of sodium carbonate and sodium sulfate were mixed in a Kitchen Aid blender, followed by the dropwise addition of the nonionic surfactant, Polytergent SLF-18. Sodium silicate was then dripped onto he mixture. Sodium phosphonate powder (Dequest 2016D) as the powdered anti-scalant agent was then sprinkled on the silicated alkaline salts which were being mixed in he blender. The blended mixture was fluidized as in Example 1 and solubility determined.

| | Example 4 |
|---|---|
| Sodium carbonate | 30.00 |
| Sodium sulfate | 23.50 |
| Polytergent SLF-18 | 3.50 |
| Sodium silicate, 2.4r | 11.00 |
| Phosphonate (powder) | 2.40 |
| Sodium citrate dihydrate | 20.00 |
| Clearon CDB-56 | 3.50 |
| Perfume | 0.20 |
| Water | 5.90 |
| Solubility rating | 0 |

EXAMPLE 5-6

The processes of Examples 3 and 4 above were scaled up in a pilot plant as follows: 50 pound batches of variations of Examples 3 and 4 were prepared as Examples 5-6.

For Example 5, soda ash was charged in a Lodige mixer and an acidic liquid anti-scalant agent, Dequest 20I0 was sprayed onto the soda ash at 100° F. Sodium sulfate was then added to the mixture followed by spraying of the nonionic surfactant, Polytergent SLF-18, which was heated to between 115°-130° F., on the salt admixture. Aqueous sodium silicate was heated to 175° F. and sprayed on the mixture with mixing continued for two additional minutes in a Lodige mixer at a speed of 160 rpm. The resulting mixture was then screened through a 10 mesh screen, and dried in a fluid bed for between 15 to 25 minutes until the powder attained a temperature in the range of 125°-145° F. Perfume was then sprayed on the fluidized premix and the premix was combined with sodium citrate and the chlorine source.

For Example 6, soda ash and sodium sulfate were charged in a Lodige mixer and the nonionic surfactant was heated to between 115°-130° F. before it was sprayed onto the alkaline salt blend. Sodium silicate was heated to 175° F. and was then sprayed on the mixture. A powdered anti-scalant, Dequest 20-16D, was added to the moist agglomerated salts in the mixer and blended for 1-2 minutes. This premix was then fluidized and combined with the other detergent ingredients a in Example 5.

The particle size distributions, densities and solubilities, for Example 5-6 are listed in Table 3 below, together with he nominal level and analytically determine level of phosphorus that the phosphonate adds to the formulations. The phosphorus level found shows the phosphonate was agglomerated successfully. The extend of phosphonate agglomeration cannot be inferred from the "fines" (−50) level inasmuch as mixing in the Lodige mixer results in some particle attrition as noted by the observation that Example 5 made with liquid phosphonate has more than 4 times the level of fines observed in Example 6 made with solid phosphonates.

| | Examples 5-6 | |
|---|---|---|
| | 5 | 6 |
| Sodium carbonate | 38.00 | 38.00 |
| Phosphonate | 2.40 (aq)[a] | 2.40 (solid)[b] |
| Sodium sulfate | 18.40 | 16.30 |
| Polytergent SLF-18 | 3.50 | 3.50 |
| Sodium silicate, 2.4r | 9.00 | 9.00 |
| Sodium citrate dihydrate | 20.00 | 20.00 |
| Clearon CDB-56 | 3.50 | 3.50 |
| Perfume | 0.20 | 0.20 |
| Water | 5.00 | 5.00 |

[a]Dequest 2010 supplied by Monsanto
[b]Dequest 2016D supplied by Monsanto

TABLE 3

| U.S. Screen No. | Screen Opening μm | Example 5-Liquid | Example 6-Solid |
|---|---|---|---|
| 10 | 2,000 | 0 | 0 |
| 12 | 1,700 | 1.5 | 2.0 |
| 14 | 1,400 | 4.0 | 5.1 |
| 20 | 850 | 21.5 | 24.2 |
| 35 | 500 | 38.0 | 45.5 |
| 50 | 300 | 26.0 | 21.2 |
| −50 | 300 | 9.0 | 2.0 |
| | | 100.0% | 100.0% |
| Density g/cc | | 0.99 | 0.93 |
| Solubility | | 0 | 0 |
| Weight Loss at 70° C. | | 2.9 | 3.6 |
| Weight Loss at 135° C. | | 5.0 | 7.1 |
| % Phosphorus, Nominal | | 0.72 | 0.72 |
| % Phosphorus, Analytical | | 0.59 | 0.65 |

EXAMPLE 7

Example 7 is analogous to Example 6 in that powdered sodium polyacrylate, Alcosperse 602 ND, was agglomerated in a process which was scaled up to make a 50 pound batch. The regimen used for Example 6 was followed, but powdered Alcosperse 602 ND was substituted for powder phosphonate. Following fluidization, a sample was withdrawn for analytical determination of the sodium polyadrylate content.

| | Example 7 |
|---|---|
| Sodium carbonate | 38.00 |
| Sodium sulfate | 15.94 |
| Polytergent SLF-18 | 3.50 |
| Sodium silicate, 2.4r | 9.00 |
| Alcosperse 602 ND | 4.86 |
| Sodium citrate dihydrate | 20.00 |
| Clearon CDB-56 | 3.50 |
| Perfume | 0.20 |
| Water | 5.00 |
| % Sodium polyacrylate, nominal | 4.45 |
| % Sodium polyacrylate, analytical | 4.30 |

The Alcosperse 602 ND was agglomerated successfully in the finished product.

EXAMPLE 8-9

The spotting and filming performance of the formulations of Examples 1 and 2, according to the invention was compared to that of a zero-P formulation containing citrate but no soda ash and no anti-scalant agent and a commercial automatic powdered dishwasher product (ADP). 25 gms. samples of each of the formulations of Examples 1 and 2 and the zero-P formulation were used in main washes. The ADP contained chlorine bleach and was at a level of 47.4 gms. Ten dinner plates and ten glass tumbles were placed in a Sears Kenmore dishwasher. 40 gms of a 4:1 mixture of margarine and powdered milk were placed in the dishwasher. The amount of detergent indicated above for each of the samples was placed in the dishwasher dispenser cup and the machine was started. After repeating the test through three wash cycles, glasses were visually inspected, rated and placed in a different dishwasher for three additional washes. The washes and rotations were repeated through the four machines for a total of 12 wash cycles. Water temperature was 135° F. and water hardness was 130 ppm. After each wash cycle the glasses were rated numerically for spotting and filming on a scale of 0 to 4 (0 =best; and 4 =worst) for spotting, and 0 to 5 (0 =best; 5 =worst) for filming. Differences of abut 0.5 in spotting and 1.0 in filming are considered perceptible. Commercial dishwashing products both powder (ADP-B) and liquid (ADL-C and ADL-D) from a separate test are included to show scores obtained for commercially available products. Product ADP-B is the same as ADP-A but was used at 24.4 gms (one half cups). The ADLs were used at equal volume (half cup) to ADP-B, but the weights are higher for the liquids due to their specific gravities. The results of the spotting and filming test are shown below:

EXAMPLE 8-9

| Example | Product | Use Level | Avg. of 12 washes Spotting | Filming |
|---|---|---|---|---|
| 8 | Example 1 | 25 gm | 1.4 | 1.4 |

-continued

| Example | Product | Use Level | Avg. of 12 washes Spotting | Filming |
|---|---|---|---|---|
| 9 | Example 2 | 25 gm | 1.7 | 1.6 |
| — | Zero-P/No Soda Ash | 25 gm | 1.6 | 1.1 |
| — | Commercial ADP-A | 47.4 gm | 0.2 | 0.9 |
| — | Commercial ADP-B | 26.4 gm | 0.9 | 1.1 |
| — | Commercial ADL-C | 42.0 gm | 2.5 | 1.2 |
| — | Commercial ADL-D | 42.0 gm | 2.6 | 1.2 |

The direct comparison of spotting and filming scores of Examples 8 and 9 show that glassware appearance is acceptable when the detergents are used at about half the level of commercial powder ADP-A, and comparable with the zero-P detergent which did not contain soda ash. The indirect comparison with commercial products ADP-B, ADL-C, and ADL-D shows Examples 8 and 9 perform better in spotting than liquids ADL-C and ADL-D but powder ADP-B was better. All products perform equally in filming.

EXAMPLE 10–11

Dishwashers are not used daily in all homes, and consumers often "store" used tableware until the dishwasher contains a full load. Estimates indicate that about three-fourths of automatic dishwasher users pretreat tableware by scraping, rinsing, etc. A fifty cycle wash test, without the margarine/milk soil was run on Examples 1 and 2 and the zero-P formulations which were used for Examples 8–9. In this instance, commercial product ADP-E, a zero-P product built with citrate but no soda ash which contains enzymes and an oxygen bleach, was used as a control. All products were used at 25 gm in the main wash. In the 50 wash test, glasses were not rotated and spotting and filming scores were read only at the end of the test. Without soil, all glasses were equal in spotting. Filming scores for Example 11 which contained soda ash and a polyacrylate anti-scalant agent and commercial product ADP-E without soda ash were comparable.

| Example | Product | Use Level | Examples 10–11 Spotting | Filming |
|---|---|---|---|---|
| 10 | Example 1 | 25 gm | 0.1 | 0 |
| 11 | Example 2 | 25 gm | 0.4 | 2.7 |
| | Zero-P/No soda ash | 25 gm | 0.1 | 1.5 |
| | Commercial ADP-E | 25 gm | 0 | 2.6 |

EXAMPLE 12

Liquid anti-scalants are sometimes less expensive than a solid anti-scalants. Liquid anti-scalants contain less than 50% solids and therefore carry an equal or greater weight of water into the formulation. The zero-P builder, soda ash, does not have the same capacity to pick up water as the conventional phosphate builder sodium tripolyphosphate. When aqueous anti-scalants are loaded onto the soda ash and other salts, such as sodium sulfate or onto a soda ash/salt mixture prior to, together with, or after aqueous silicate is added to the formulation, a slurry might result. Such a slurry cannot be processed in equipment used for the manufacturing of powdered automatic dishwashing detergents. Besides using the solid powdered anti-scalants as described in Examples 5–6, a second alternative process requires the granulation of the liquid anti-scalant by spraying the aqueous solution onto a portion of the builder/salt mixture or a combination of both and then drying the anti-scalant mixture. Drying may be accomplished in a drum dryer, via fluidization, or other means known in the art. Example 12 shown below Was prepared by spraying the liquid anti-scalant, Alcosperse 602-N, onto soda ash and sodium sulfate, and then drying the formulation via fluidization.

EXAMPLE 13

The formulation of Example 12 includes 250 parts of the liquid anti-scalant, Alcosperse 602-N consisting of 45% sodium polyacrylate and 55% water sprayed onto the solids of the formulation to form a mixture. The mixture was then dried at 80° C. for 12 minutes in an Aeromatic fluidizer. The formulation of Example 12 is as follows:

| Ingredients | Example 12 As is | After Drying |
|---|---|---|
| Sodium carbonate | 425 | 42 |
| Sodium Sulfate | 150 | 150 |
| Alcosperse 602-N (45% solids) | 250 | 112.5 |
| Total parts | 825 | 687.5 |

The product of Example 12 is combined with a premix to give the finished product of the composition of Example 13.

| | Premix | Parts Example 12 | Example 13 |
|---|---|---|---|
| Sodium carbonate | 21.00 | 17.00 | 38.00 |
| Sodium Sulfate | 10.30 | 6.00 | 16.30 |
| Sodium polyacrylate | — | 4.50 | 4.50 |
| Polytergent SLF-18 | 3.50 | — | 3.50 |
| Sodium silicate 2.4r | 9.00 | — | 9.00 |
| Sodium citrate dihydrate | 20.00 | — | 20.00 |
| Clearon CD B-56 | 3.50 | — | 3.50 |
| Perfume | 0.20 | — | 0.20 |
| Water | 5.00 | — | 5.00 |

We claim:

1. A process for making a powder detergent comprising the steps of:

(a) adding about 0.5 to about 15% of an aqueous anti-scalant agent having acidic functionalities and used to inhibit microscopic nuclei development to bout 20% to about 40% of a sodium carbonate to neutralize the anti-scalant agent in situ and form a neutralized anti-scalant mixture;

(b) combining the neutralized anti-scalant mixture with up to 30% sodium sulfate and about 0.6 to bout 6% of a nonionic surfactant to form a blended mixture;

(c) spraying about 10% to 40% liquid sodium silicate onto the blended mixture to form an agglomerated silicate mixture;

(d) fluidizing the agglomerated silicate mixture to reduce a total amount of water introduced from the aqueous anti-scalant and the liquid sodium silicate to the silicate mixture from about 11% to about 20% to less than about 4.5% free moisture; and (e) thereafter adding about 10 to about 60% of one or more non-phosphate based builders selected from the group of water soluble salts of amino polycarboxylic acids and hydroxy carboxylate acids, polyacrylate compounds having a molecular weight of greater than about 5000, polyacetal carboxylates, alumino silicates, sodium and potassium salts of phytates, polyphosphonates, oxydisuccinates, oxydiacetates, carboxymethyloxy succinates, tartrate monoacetates, tartrate diacetates, tetracarboxylates, starch, oxidized heteropolymeric polysaccharide and mixtures thereof, and a halogen bleaching agent in an amount to provide about 0.2 to about 2.0 wt. % available chlorine or a peroxygen bleaching agent in an amount of 0.5 to 20% by weight to form a powder detergent.

2. The process according to claim 1, wherein the aqueous anti-scalant agent is hydroxyethylidene disphosphonic acid.

3. The process according to claim 1, wherein the builder is selected from the group consisting of sodium citrate, trisodium carboxymethyloxy succinate, nitrilotriacetate, dipicolinic acid, tartrate monosuccinates, tartrate disuccinates, oxydisuccinates and mixtures thereof.

4. The process according to claim 3, wherein the amount of said builder is about 10 to about 45 weight percent.

5. The process according to claim 1, wherein the alkaline agent is selected from the group consisting of sodium carbonate, sodium bicarbonate, sodium sesquicarbonate and mixtures thereof.

6. The process according to claim 1, wherein the inorganic salt of step (a) is sodium sulfate.

7. A process for making a powder detergent which is substantially phosphate free comprising the steps of:

(a) spreading about 0.5 to about 15% of a liquid anti-scalant agent having acidic functionalities or its neutralized equivalent and used to inhibit microscopic nuclei development onto about 10 to 20% of an alkaline agent selected from the group of an alkali metal or ammonium carbonate, bicarbonate sesquicarbonate, and mixtures thereof and 0 to 25 wt. % of an alkali metal inorganic salt provided the alkali metal inorganic salt is not liquid sodium silicate, to neutralize the acidic functionalities of the anti-scalant agent in situ and form a neutralized anti-scalant mixture, the anti-scalant agent introducing a total amount of water of about 5% to the anti-scalant mixture;

(b) drying the neutralized anti-scalant mixture to form particles having a residue moisture of less than about 5% water and a maximum of 5% of the particles retained on a 14 mesh U.S. Screen and no more than 10% of the particles going through a 50 mesh U.S. Screen;

(c) forming a main mixture comprising the particles of step b, 0 to 20% of a second alkaline agent selected from the group of an alkali metal or ammonium carbonate, bicarbonate, sesquicarbonate and mixtures thereof, 0.6 to about 6.0% of a nonionic surfactant and 0 to about 70% of a filler salt selected from the group selected from the group of alkali metal chloride, ammonium chloride, borax or mixtures thereof, with sodium sulfate to form a blended mixture;

(d) agglomerating the blended mixture with from about 10% to about 40% liquid sodium silicate to form an agglomerated silicate mixture, the liquid sodium silicate introducing a total amount of water of about 10% into the blended mixture;

(e) fluidizing the agglomerated silicate mixture to form granules of approximately the same size as the particles of step (b);

(f) adding about 10 to about 60% of a non-phosphate based builder selected from the group of water soluble salts of amino polycarboxylic acids and hydroxy carboxylate acids, polyacrylate builders, polyacetal carboxylates, alumino silicates, sodium and potassium salts of phytates, polyphosphonates, oxydisuccinates, oxydiacetates, carboxymethyloxy, succinates, tartrate monoacetates, tartrate diacetates, tetracarboxylates, starch, oxidized heteropolymeric polysaccharide and mixtures thereof and a halogen bleaching agent in an mount to provide about 0.2 to about 2.0 wt.% available chlorine or a peroxygen bleaching agent in an amount of 0.5 to 20% by weight to the granules of step (e) to form a granulated alkaline blend; and (g) blending together the granulated alkaline blend of step (f) and the dried particles of step (b) to form a powder detergent having a free moisture content of less than about 4.5%.

8. The process according to claim 7, wherein the liquid anti-scalant agent is hydroxyethylidene diphosphonic acid or sodium polyacrylate.

9. The process according to claim 7, wherein the builder is selected from the group consisting of sodium citrate, trisodium carboxymethyloxy succinate, nitrilotriacetate dipicolinic acid, tartrate monosuccinates, tartrate disccines, oxydisuccinates and mixtures thereof.

* * * * *